US009548154B2

(12) United States Patent
Shudarek

(10) Patent No.: US 9,548,154 B2
(45) Date of Patent: Jan. 17, 2017

(54) INTEGRATED REACTORS WITH HIGH FREQUENCY OPTIMIZED HYBRID CORE CONSTRUCTIONS AND METHODS OF MANUFACTURE AND USE THEREOF

(71) Applicant: MTE Corporation, Menomonee Falls, WI (US)

(72) Inventor: Todd Shudarek, West Bend, WI (US)

(73) Assignee: MTE Corporation, Menomonee Falls, WI (US)

( * ) Notice: Subject to any disclaimer, the term of this patent is extended or adjusted under 35 U.S.C. 154(b) by 0 days.

(21) Appl. No.: 14/942,556

(22) Filed: Nov. 16, 2015

(65) Prior Publication Data

US 2016/0148746 A1 May 26, 2016

Related U.S. Application Data

(60) Provisional application No. 62/080,054, filed on Nov. 14, 2014.

(51) Int. Cl.

| | |
|---|---|
| ***H01F 27/28*** | (2006.01) |
| ***H01F 27/26*** | (2006.01) |
| ***H01F 27/02*** | (2006.01) |
| ***H01F 27/30*** | (2006.01) |
| ***H01F 27/29*** | (2006.01) |
| ***H01F 30/12*** | (2006.01) |

(52) U.S. Cl.

CPC ..... *H01F 27/263* (2013.01); *H01F 27/02* (2013.01); *H01F 27/28* (2013.01); *H01F 27/29* (2013.01); *H01F 27/30* (2013.01); *H01F 30/12* (2013.01)

(58) Field of Classification Search

CPC ..... H01F 27/00–27/30

USPC ..... 336/210–215, 220–223, 233–234

See application file for complete search history.

(56) References Cited

U.S. PATENT DOCUMENTS

| | | | | |
|---|---|---|---|---|
| 3,659,191 | A * | 4/1972 | Spreadbury | G05F 3/06 323/248 |
| 5,371,486 | A * | 12/1994 | Yamada | H01F 27/33 336/212 |
| 7,978,044 | B2 * | 7/2011 | Takeuchi | H01F 27/245 336/212 |
| 8,692,644 | B2 * | 4/2014 | Shudarek | H02J 3/01 336/212 |

(Continued)

OTHER PUBLICATIONS

International Search Report and Written Opinion from International Application No. PCT/US2015/060914 dated Jan. 27, 2016.

*Primary Examiner* — Tuyen Nguyen

(74) *Attorney, Agent, or Firm* — Greenberg Traurig, LLP

(57) ABSTRACT

In some embodiments, an exemplary inventive device of the instant invention is a reactor which includes at least the following: a core, including: at least one leg, including: a first lamination, where the first lamination is made from a high permeability material, where the high permeability material has a magnetic permeability that is at least 1000 times greater than the permeability of air; a second lamination, where second lamination is made from the high permeability material; a bracket, where the bracket is configured to secure the first lamination and the second lamination in a spatial arrangement to have a space between each other; and a plurality of blocks made from a low permeability material, where the low permeability material has the magnetic permeability that is less than 100 times the permeability of air.

9 Claims, 4 Drawing Sheets

(56) References Cited

U.S. PATENT DOCUMENTS

| | | | | |
|---|---|---|---|---|
| 2006/0250207 | A1* | 11/2006 | Shudarek ..... | H01F 27/24<br>336/212 |
| 2010/0171580 | A1 | 7/2010 | Abe et al. | |
| 2011/0234360 | A1 | 9/2011 | Nakanoue et al. | |
| 2012/0256719 | A1 | 10/2012 | Shudarek et al. | |
| 2012/0326822 | A1 | 12/2012 | Yokota et al. | |

* cited by examiner

INTEGRATED REACTORS WITH HIGH FREQUENCY OPTIMIZED HYBRID CORE CONSTRUCTIONS AND METHODS OF MANUFACTURE AND USE THEREOF

RELATED APPLICATIONS

This application claims the priority of U.S. provisional patent application No. 62/080,054; filed Nov. 14, 2014; entitled "INTEGRATED THREE PHASE REACTORS WITH HIGH FREQUENCY THREE PHASE OPTIMIZED HYBRID CORE CONSTRUCTIONS AND METHODS OF MANUFACTURE AND USE THEREOF," which is incorporated herein by reference in its entirety for all purposes.

FIELD OF INVENTION

In some embodiments, the instant invention relates to three phase reactors and methods of manufacture and use thereof.

BACKGROUND

Typically, line reactors are current-limiting devices and oppose rapid changes in current because of their impedance. Typically, they hold down any spikes of current and limit any peak currents.

SUMMARY OF INVENTION

In some embodiments, an exemplary inventive device of the instant invention is a reactor which includes at least the following: at least one core, including: at least one leg, including: at least one first lamination, where the at least one first lamination is made from at least one first high permeability material, where the at least one first high permeability material has a magnetic permeability that is at least 1000 times greater than the permeability of air; at least one second lamination, where the at least one second lamination is made from at least one second high permeability material, where the at least one second high permeability material has the magnetic permeability that is at least 1000 times greater than the permeability of air; at least one bracket, where the at least one bracket is configured to secure the at least one first lamination and the at least one second lamination in a spatial arrangement to have a space between each other; and a plurality of blocks made from at least one low permeability material, where the at least one low permeability material has the magnetic permeability that is less than 100 times the permeability of air.

In some embodiments, the at least one first high permeability material and the at least one second high permeability material are made from the same magnetic silicon steel material. In some embodiments, the reactor further includes at least one nonmagnetic insulation positioned in at least one gap between: i) at least two blocks of the plurality of blocks, or ii) at least one block and one of the at least one first lamination and the at least one second lamination. In some embodiments, each of the plurality of blocks is made from at least one material, selected from the group, consisting of: i) sendust material, ii) molypermalloy material, iii) Fluxsan™ material, iv) Hi-Flux™ material, and v) Optilloy™ material. In some embodiments, the plurality of blocks are configured to be vary in at least one spatial characteristic, where the at least one spatial characteristic is one of: i) a shape, and ii) a size. In some embodiments, the plurality of blocks include: at least one first block, and at least one second block where the at least one first block and the at least one second block are configured to: i) differ in the at least one spatial characteristic, and ii) fit with each other in the space between the at least one first lamination and the at least one second lamination.

In some embodiments, the plurality of blocks are configured to fit with each other in the space between the at least one first lamination and the at least one second lamination so that at least one gap is absent.

In some embodiments, the plurality of blocks are configured to fit with each other in the space between the at least one first lamination and the at least one second lamination to result in at least one gap fittable to be filled with at least one nonmagnetic insulation. In some embodiments, the reactor is a three phase reactor, and the at least one core further includes: at least one first leg, configured as the at least one leg; at least one second leg, configured as the at least one leg; and at least one third leg, configured as the at least one leg.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

Figure 1:
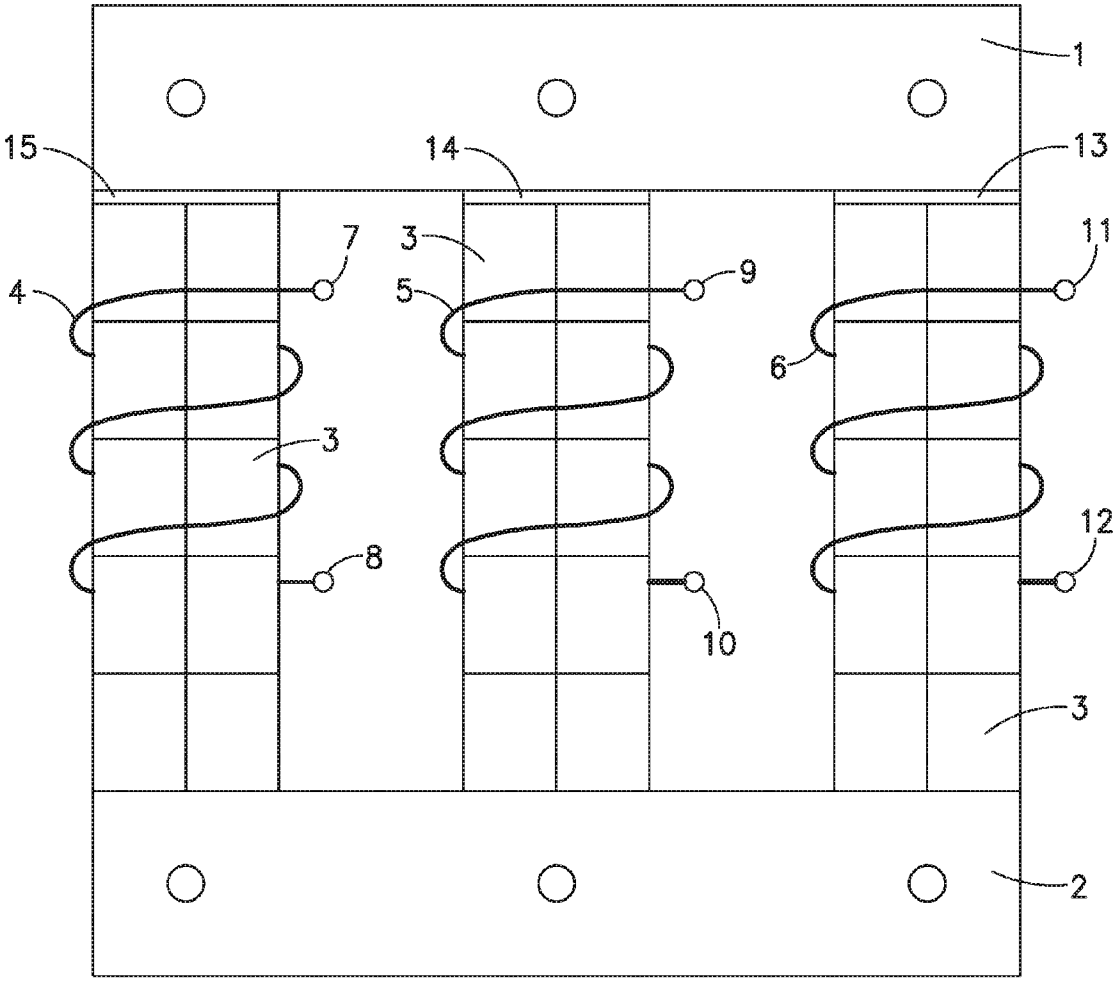
FIGS. 1-4 are schematic snapshots that illustrate certain aspects of the instant invention in accordance with some embodiments of the instant invention.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DETAILED DESCRIPTION

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

In some embodiments, core(s) of the integrated three phase reactors in accordance with principles of the instant invention can be based on sendust material and/or other similarly suitable materials. For example, a composition of the sendust material is typically 85% iron, 9% silicon and 6% aluminum. Typically, sendust cores have low core loss at higher frequencies (almost zero (0) magnetostriction); low coercivity (5 A/m) good temperature stability and saturation flux density up to 1 T. Further, Sendust typically exhibits simultaneously zero (0) magnetostriction and zero (0) magneto crystalline anisotropy constant K1. In some embodiments, the sendust-based core(s) of the integrated three phase reactors in accordance with principles of the instant invention are integrated three phase cores with low permeability blocks that have balanced inductance. Suitable manufacturers of sendust material include, but not limited to, Hengdian Group DMEGC Magnetics Co., Ltd (China, http://www.chinadmegc.com); Micrometals Arnold Powder Cores, Inc. (Anaheim, Calif.; http://www.micrometalsarnoldpowdercores.com); Magnetics (Pittsburgh, Pa.; http://mag-inc.com).

For example, aside from sendust materials, the inventive core(s) of the exemplary inventive integrated three phase reactors in accordance with principles of the instant invention can be made from the following materials produced by Micrometals Arnold Powder Cores:

Molypermalloys, containing nickel, iron molybdenum alloy powder material;

Fluxsan™, containing 6.5% silicon, iron alloy powder material;

Hi-Flux™, containing 50/50 nickel, iron alloy powder material; and

Optilloy™—hybrid alloy powder material.

In some embodiments, the inventive core(s) of the inventive integrated three phase reactors in accordance with principles of the instant invention can be made from any other material which is similarly suitable in its composition and/or properties to at least one material which is specifically identified herein.

As illustrated in FIG. 1, in some embodiments, an exemplary core of an exemplary integrated three phase reactor constructed in accordance with principles of the instant invention at least can have laminations (1 and 2) and sendust blocks (3) in the exemplary core structure between the laminations (1 and 2). In some embodiments, the laminations (1 and 2) can be constructed from magnetic silicon steel and/or any other similarly suitable material of comparable magnetic characteristics.

In some embodiments, the sendust blocks (3) can have various shapes (e.g., quadrilateral (e.g., square, rectangular, trapezoid, etc.), etc.) and sizes (e.g., 3 inch×1.5 inch×4 inch) if they still fit together to fill in a space between the laminations (1 and 2) and have no gapes between the sendust blocks (3). In some embodiments, the sendust blocks (3) can have various shapes and sizes within the same core leg and/or the same core if they still fit together to fill in a space between the laminations (1 and 2) and have no gapes between the sendust blocks (3). For example, FIG. 1 shows numerous similarly sized front views of the Sendust blocks 3.

In some embodiments, there may be a non-magnetic insulation in relatively small gap(s) (e.g., 0.03 inch or less) next to some or all of the blocks. In some embodiments, there may be a non-magnetic insulation in relatively small gap(s) (e.g., 0.2 inch or less) next to some or all of the blocks. In some embodiments, there may be a non-magnetic insulation in relatively small gap(s) (e.g., 0.1 inch or less) next to some or all of the blocks. In some embodiments, there may be a non-magnetic insulation in relatively small gap(s) (e.g., 0.01 inch or less) next to some or all of the blocks. For example, FIG. 1 illustrates exemplary positions of gaps (13, 14, 15) having the nonmagnetic insulation. In some embodiments, the nonmagnetic insulation in the gaps (13, 14, 15) can be made from various suitable materials such as Dupont Nomex and/or fiberglass-reinforced thermoset polyesters, manufactured by Glastic Corporation, Cleveland, Ohio.

In some embodiment, in the illustrative example of FIG. 1, the exemplary three phase reactor constructed in accordance with principles of the instant invention has a winding (4) with terminals (7, 8); a winding (5) with terminals (9, 10); and a winding (6) with terminals (11,12).

Figure 2:
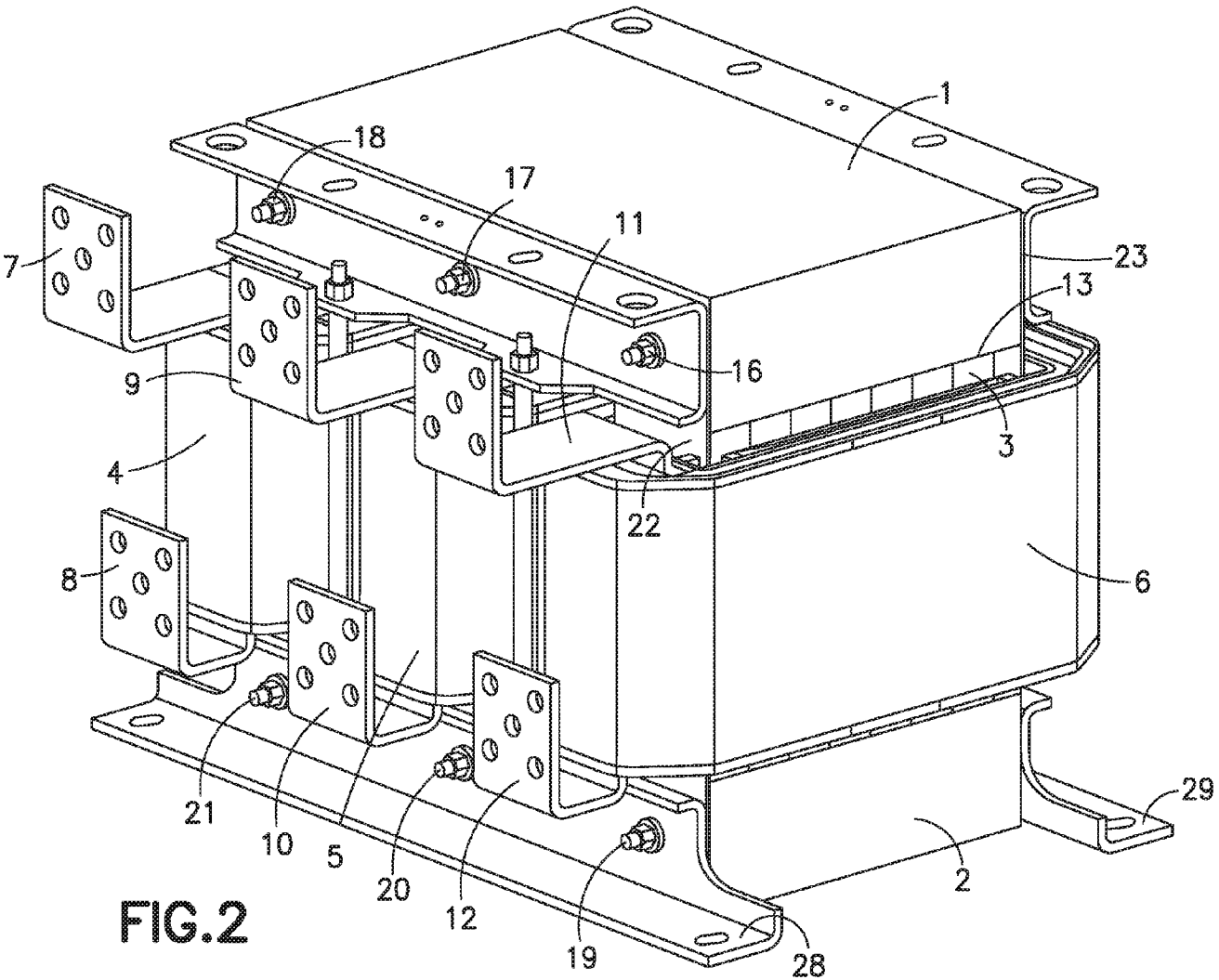
Figure 3:
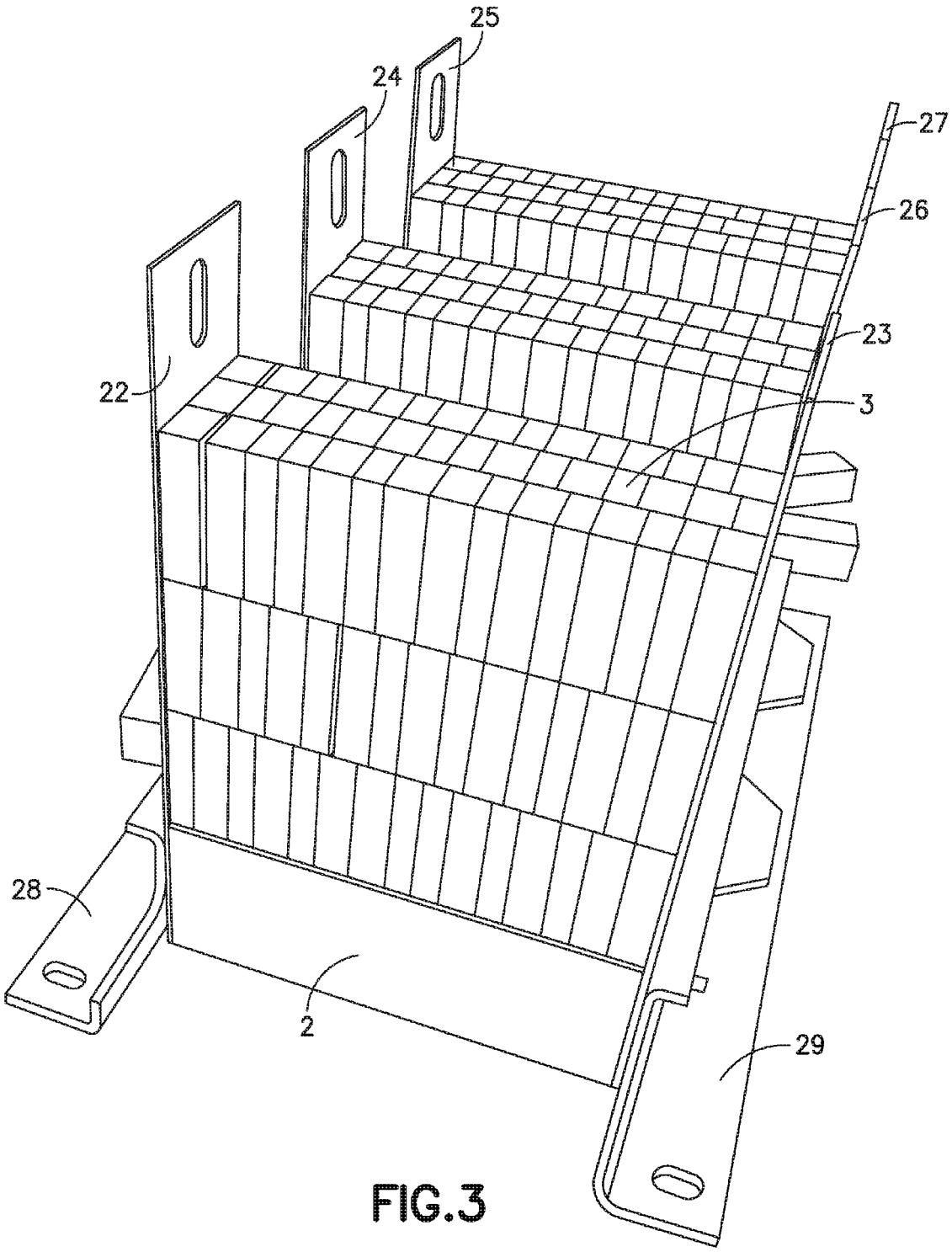

FIG. 2 showing an exemplary three phase reactor constructed in accordance with principles of the instant invention. FIG. 3 shows an exemplary partial construction of an exemplary three phase reactor constructed in accordance with principles of the instant invention. In FIG. 2, the exemplary three phase reactor has a winding (4) with terminals (7, 8) and a winding (5) with terminals (9, 10) and a winding (6) with terminals (11, 12). As shown in FIGS. 2 and 3, the exemplary core structure has six vertical non-magnetic straps (22, 24, 25, 23, 26, and 27). As shown in FIGS. 2 and 3, there can be 6 bolts or threaded rods with associated hardware (16, 17, 18, 19, 20, and 21) that secure mounting brackets (28, 29) which secure the straps (22, 24, 25, 23, 26, and 27) and the laminations (1, 2). As shown in FIGS. 2 and 3, the sendust blocks (3) and gaps (13, 14, 15) having insulation are positioned between the laminations (1,2).

In some embodiments, depending on the size, shape, and/or dimensions of a space between laminations, there can be at least 2 blocks of the instant invention placed between the laminations. In some embodiments, depending on the size, shape, and a space between laminations, there can be at least 5 blocks of the instant invention placed between the laminations. In some embodiments, depending on the size, shape, and a space between laminations, there can be at least 10 blocks of the instant invention placed between the laminations. In some embodiments, depending on the size, shape, and a space between laminations, there can be at least 20 blocks of the instant invention placed between the laminations. In some embodiments, depending on the size, shape, and a space between laminations, there can be at least 50 blocks of the instant invention. In some embodiments, depending on the size, shape, and a space between laminations, there can be at least 100 blocks of the instant invention placed between the laminations. In some embodiments, depending on the size, shape, and a space between laminations, there can be between 5 and 100 blocks of the instant invention placed between the laminations. In some embodiments, depending on the size, shape, and a space between laminations, there can be between 5 and 100 blocks of the instant invention placed between the laminations. In some embodiments, depending on the size, shape, and a space between laminations, there can be between 10 and 1,000 blocks of the instant invention placed between the laminations. In some embodiments, depending on the size, shape, and a space between laminations, there can be between 10 and 10,000 blocks of the instant invention placed between the laminations. In some embodiments, depending on the size, shape, and a space between laminations, there can be between 2 and 100 blocks of the instant invention placed between the laminations. In some embodiments, depending on the size, shape, and a space between laminations, there can be between 2 and 1,000 blocks of the instant invention placed between the laminations.

In some embodiments, core(s) of the integrated three phase reactors in accordance with principles of the instant invention can have sufficient performance, when, for example but not limited to, are used in filters that operate in frequency ranges from 2 to 16 kHz. In some embodiments, core(s) of the integrated three phase reactors in accordance with principles of the instant invention sufficiently reduce(s) the fringing fields along the core legs, minimizing or preventing any appreciable (e.g., measurable) amount of winding (4, 5, 6) heating due to the gaps. In some embodiments, the high permeability of the laminations (1, 2) can balance the inductances of each of the phases.

As used herein, "high permeability" means a magnetic permeability that is at least 1000 times greater than the permeability of air, and "low permeability" means a magnetic permeability that is less than 100 times the permeability of air.

Figure 4:
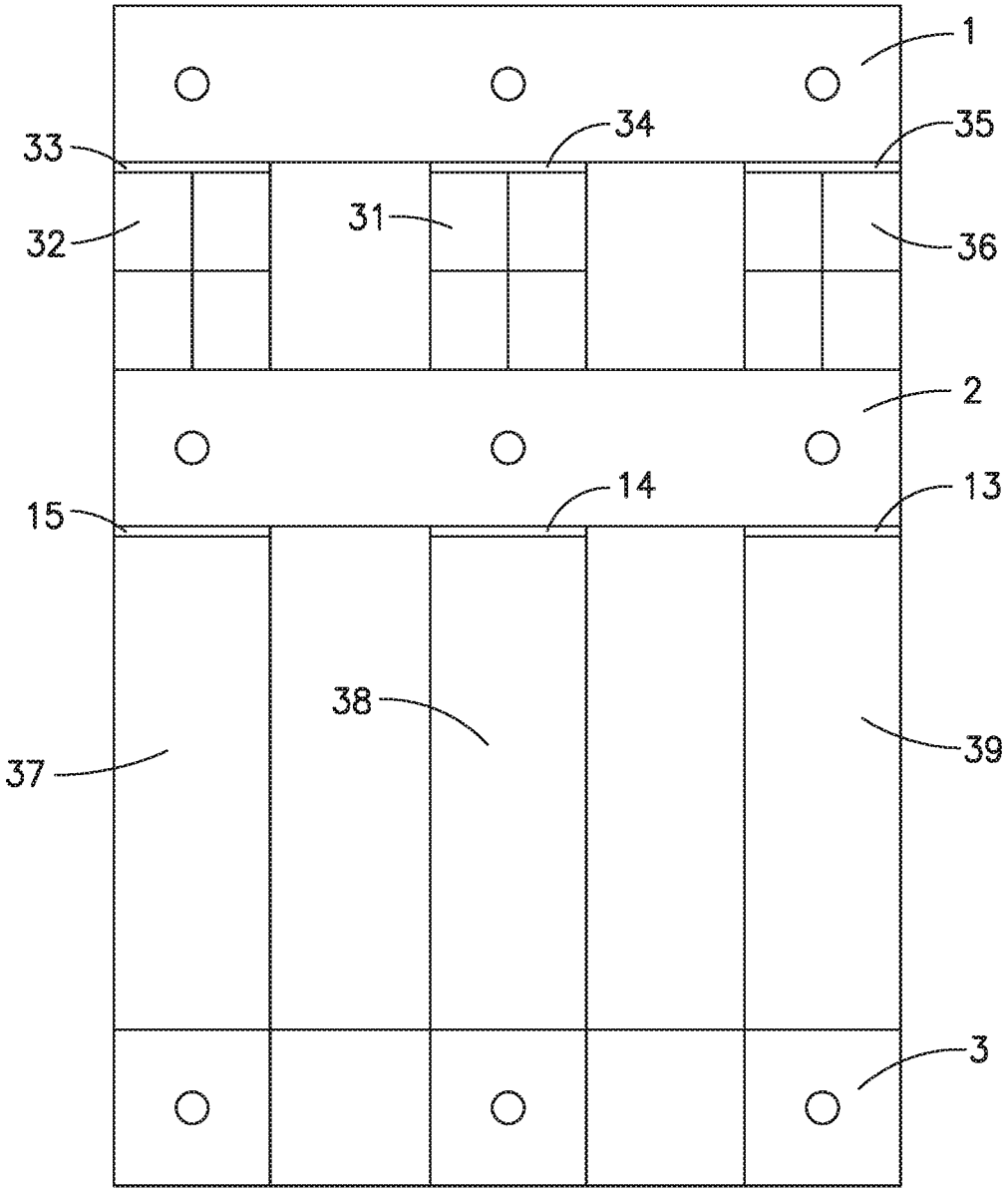

As shown in FIG. 4, in some embodiments, core(s) of the integrated three phase reactors in accordance with principles of the instant invention can be implemented consistent with the U.S. Pat. No. 7,142,081 to Shudarek. In FIG. 4, bridges are laminations 1, 2, 3 and at least three of the legs 36, 32, 31 are constructed from sendust low permeability material. In FIG. 4, the legs 37, 38, 39 are constructed from laminations. In FIG. 4, gaps (13, 14, 15, 33, 34, 35) have nonmagnetic material.

In some embodiments, core(s) of the integrated three phase reactors in accordance with principles of the instant invention, such as shown in FIG. 1, can be used with multiple windings consistent with U.S. Pat. No. 7,378,754 to Shudarek, enclosed hereinto and hereby incorporated by references for such purposes.

In some embodiments, core(s) of the integrated three phase reactors in accordance with principles of the instant invention, such as shown in FIG. 1, can be used with multiple windings consistent with US Patent Application Pub. No. 20140300433, DRIVE OUTPUT HARMONIC MITIGATION DEVICES AND METHODS OF USE THEREOF, enclosed hereinto and hereby incorporated by references for such purposes.

In some embodiments, an exemplary inventive device of the instant invention is a reactor which includes at least the following: at least one core, including: at least one leg, including: at least one first lamination, where the at least one first lamination is made from at least one first high permeability material, where the at least one first high permeability material has a magnetic permeability that is at least 1000 times greater than the permeability of air; at least one second lamination, where the at least one second lamination is made from at least one second high permeability material, where the at least one second high permeability material has the magnetic permeability that is at least 1000 times greater than the permeability of air; at least one bracket, where the at least one bracket is configured to secure the at least one first lamination and the at least one second lamination in a spatial arrangement to have a space between each other; and a plurality of blocks made from at least one low permeability material, where the at least one low permeability material has the magnetic permeability that is less than 100 times the permeability of air.

In some embodiments, the at least one first high permeability material and the at least one second high permeability material are made from the same magnetic silicon steel material. In some embodiments, the reactor further includes at least one nonmagnetic insulation positioned in at least one gap between: i) at least two blocks of the plurality of blocks, or ii) at least one block and one of the at least one first lamination and the at least one second lamination. In some embodiments, each of the plurality of blocks is made from at least one material, selected from the group, consisting of: i) sendust material, ii) molypermalloy material, iii) Fluxsan™ material, iv) Hi-Flux™ material, and v) Optilloy™ material. In some embodiments, the plurality of blocks are configured to be vary in at least one spatial characteristic, where the at least one spatial characteristic is one of: i) a shape, and ii) a size. In some embodiments, the plurality of blocks include: at least one first block, and at least one second block where the at least one first block and the at least one second block are configured to: i) differ in the at least one spatial characteristic, and ii) fit with each other in the space between the at least one first lamination and the at least one second lamination.

In some embodiments, the plurality of blocks are configured to fit with each other in the space between the at least one first lamination and the at least one second lamination so that at least one gap is absent. In some embodiments, the plurality of blocks are configured to fit with each other in the space between the at least one first lamination and the at least one second lamination to result in at least one gap fittable to be filled with at least one nonmagnetic insulation. In some embodiments, the reactor is a three phase reactor, and the at least one core further includes: at least one first leg, configured as the at least one leg; at least one second leg, configured as the at least one leg; and at least one third leg, configured as the at least one leg.

While a number of embodiments of the present invention have been described, it is understood that these embodiments are illustrative only, and not restrictive, and that many modifications may become apparent to those of ordinary skill in the art.

What is claimed is:

1. A reactor, comprising:

at least one core, comprising:

at least one leg, comprising:

at least one first lamination, wherein the at least one first lamination is made from at least one first high permeability magnetic core material, wherein the at least one first high permeability magnetic core material has a magnetic permeability that is at least 1000 times greater than the permeability of air;

at least one second lamination, wherein the at least one second lamination is made from at least one second high permeability magnetic core material, wherein the at least one second high permeability magnetic core material has the magnetic permeability that is at least 1000 times greater than the permeability of air;

at least one bracket, wherein the at least one bracket is configured to secure the at least one first lamination and the at least one second lamination in a spatial arrangement to have a space between each other; and a plurality of blocks made from at least one low permeability magnetic core material to be positioned in the space between the at least one first lamination and the at least one second lamination, wherein the at least one low permeability magnetic core material has the magnetic permeability that is less than 100 times the permeability of air.

2. The reactor of claim 1, wherein the at least one first high permeability magnetic core material and the at least one second high permeability magnetic core material are made from the same magnetic silicon steel material.

3. The reactor of claim 1, further comprising at least one nonmagnetic insulation positioned in at least one gap between:

i) at least two blocks of the plurality of blocks, or ii) at least one block and one of the at least one first lamination and the at least one second lamination.

4. The reactor of claim 1, wherein each of the plurality of blocks is made from at least one magnetic core material, selected from the group, consisting of:

i) sendust material, ii) molypermalloy material, iii) Fluxsan™ material, iv) Hi-Flux™ material, and v) Optilloy™ material.

5. The reactor of claim 1, wherein the plurality of blocks are configured to be vary in at least one spatial characteristic, wherein the at least one spatial characteristic is one of:

i) a shape, and ii) a size.

6. The three phase reactor of claim 5, wherein the plurality of blocks, comprising:

at least one first block, and at least one second block wherein the at least one first block and the at least one second block are configured to:

i) differ in the at least one spatial characteristic, and ii) fit with each other in the space between the at least one first lamination and the at least one second lamination.

7. The reactor of claim 6, wherein the plurality of blocks are configured to fit with each other in the space between the at least one first lamination and the at least one second lamination so that at least one gap is absent.

8. The reactor of claim 6, wherein the plurality of blocks are configured to fit with each other in the space between the at least one first lamination and the at least one second lamination to result in at least one gap fittable to be filled with at least one nonmagnetic insulation.

9. The reactor of claim 1, wherein the reactor is a three phase reactor, and wherein the at least one core further comprises:

at least one first leg, configured as the at least one leg;

at least one second leg, configured as the at least one leg; and at least one third leg, configured as the at least one leg.

* * * * *